United States Patent [19]

Karl et al.

[11] 4,356,691

[45] Nov. 2, 1982

[54] THREAD DRAWING-OFF DEVICE AND METHOD FOR THE INSERTION OF THE DRAWN-OFF THREAD IN AN OPEN-END SPINNING DEVICE

[75] Inventors: Rupert Karl; Rudolf Oexler; Edmund Schuller; Erwin Braun; Erick Bock; Franz Schreyer, all of Ingolstadt, Fed. Rep. of Germany

[73] Assignee: Schubert & Salzer, Ingolstadt, Fed. Rep. of Germany

[21] Appl. No.: 188,680

[22] Filed: Sep. 19, 1980

[30] Foreign Application Priority Data

Sep. 29, 1979 [DE] Fed. Rep. of Germany ..... 2939706

[51] Int. Cl.[3] ..... B65H 51/28; D01H 9/02; D01H 15/00

[52] U.S. Cl. ..... 57/263; 57/279; 226/91; 242/18 R

[58] Field of Search ..... 57/261, 263, 80, 85, 57/352, 279, 404; 242/18 R, 18 A, 18 PW, 18 DD, 45, 35.5 R; 226/91

[56] References Cited

U.S. PATENT DOCUMENTS

| | | | |
|---|---|---|---|
| 3,355,868 | 12/1967 | Civrny et al. | 57/263 X |
| 3,680,300 | 8/1972 | Landwehrkamp | 57/263 |
| 3,911,658 | 10/1975 | Smith | 57/263 |
| 3,923,260 | 12/1975 | Sakurai et al. | 242/18 A |
| 4,002,305 | 1/1977 | Takeuchi et al. | 242/18 PW |
| 4,060,207 | 11/1977 | Miyazaki et al. | 57/263 X |
| 4,221,110 | 9/1980 | Smith | 57/263 |

*Primary Examiner*—Donald Watkins

[57] ABSTRACT

A pair of draw-off rollers (10, 11) of a thread drawing-off device comprising an over-mounted pressure roller (11) which cooperates resiliently with a driven roller (10) which projects across the front of the pressure roller (11). The pressure roller (11) has at least one recess (113, 114) on its front face (110) which is dimensioned in such a way that it temporarily completely releases a thread (4) sliding along the surface of the driven roller (10) and lying adjacent to the front (110) of the pressure roller (11). By means of a device of this type, the thread (4) is drawn off, for the purposes of joining, to such an extent from the spool (31) that the thread (4) reaches the side (310) of the spool (31) which is facing away from the front (110) of the pressure roller (11) provided with recesses (113, 114). The thread is then introduced into the spinning chamber (2) and is joined. The thread is then guided, using the thread tension, past the front (110) of the pressure roller (11) provided with recesses (113, 114) and introduced into the clamping line of the pair of draw-off rollers (10, 11) and is immediately subjected at this point to a predetermined draw-off.

10 Claims, 5 Drawing Figures

THREAD DRAWING-OFF DEVICE AND METHOD FOR THE INSERTION OF THE DRAWN-OFF THREAD IN AN OPEN-END SPINNING DEVICE

BACKGROUND OF THE INVENTION

The present invention relates to a thread drawing-off device for an open-end spinning device, having a pair of draw-off rollers comprising an overmounted pressure roller which cooperates resiliently with a driven roller projecting across the front of the pressure roller, and a method which may be carried out using this device.

In order to insert the thread into the clamping line of a pair of draw-off rollers comprising a driven roller and a pressure roller lying resiliently against the latter, it is known to provide the front edge of at least one roller with an annular chamfer and to insert the thread in the area of the clamping line at the front of the pair of draw-off rollers, so that it is automatically disposed in the pair of draw-off rollers as a result of the winding tension (German Auslegeschrift No. 1.685.994, FIG. 6 and 7). It is also known for this purpose, to provide the periphery of the pressure roller with a notch-shaped recess which moves into the path of the thread, grips the thread and conveys it into the clamping line of the pair of draw-off rollers (German Auslegeschrift No. 1.560.336). In both cases, there is a certain time lapse before the thread is disposed in the clamping line. The thread is introduced into the pair of draw-off rollers either only after the notch-shaped recess has traveled a certain distance, or after overcoming the clamping pressure of the two rollers. This leads to slipping, roughening, damage or breakage of the thread and, therefore, to an undefined insertion of the take-off thread. In particular, in the case of high thread take-off speeds, as is usual nowadays with open-end spinning machines, this leads to a non-uniform beginning of the thread take-off which results in variation of number in the spun thread.

SUMMARY OF THE INVENTION

The object of the present invention is, therefore, to provide a draw-off device and a method of the type enabling a substantially quicker insertion of the thread take-off between a pair of draw-off rollers.

This object is solved in accordance with the invention in that the pressure roller comprises at least one recess on its front, this recess being dimensioned such that it temporarily completely releases a thread sliding along the surface of the driven roller and lying adjacent to the front of the pressure roller. As the recess extends over an area of the periphery of the pressure roller such that the thread is temporarily released from the front of the pressure roller, the thread is able to penetrate far enough between the two rollers, so that the thread is then maintained in this position by the remaining portions of the peripheral surface of the pressure roller between the recesses. In this way, it is possible to ensure that the thread is gripped by the pressure roller and drawn-off to a predetermined extent in a certain and relatively rapid time.

It has proved to be advantageous if the recesses project approximately 1.5 to 5 mm into the peripheral surface of the pressure roller, as the thread penetrates in this way, immediately into the clamping line of the pair of draw-off rollers to such an extent that it rapidly reaches the final position.

The recesses are conveniently formed as chamfers, preferably as curved chamfers.

In order to provide as many recesses as possible on the periphery of the pressure roller, for example 6 to 8 recesses, the remaining lateral edge of the pressure roller between two adjacent recesses is advantageously shorter than the recesses.

In order to obtain a high thread tension and in order thereby to facilitate the insertion of the thread into the clamping line of the pair of draw-off rollers, the pressure roller is arranged, in accordance with a further characteristic feature of the invention, in such a way that the front of the pressure roller provided with recesses faces away from the side of the spool at which the thread reaches the spool at the time of joining.

A further simplification for the operator is achieved if the pressure roller is associated with a thread guide element which conveys the thread past the front of the pressure roller under the effect of the thread tension and only releases it in the area of the clamping line of the pair of draw-off rollers. This provides an increase in the joining reliability, as it is ensured in this way that the thread does not reach the front of the pressure roller before reaching the clamping line, which would cause a delayed insertion of the draw-off thread.

The introduction of the thread into the clamping line of the pair of draw-off rollers may be further accelerated in that the pressure roller is associated with a further thread guide element which is disposed on the front of the pressure roller and, seen from the direction of travel of the thread, in front of the pair of draw-off rollers and which guides the thread axially into the area of the clamping line of the pair of draw-off rollers under the effect of the thread tension. In this respect, the thread guide elements advantageously form a thread capture zone having a wedge-shaped development.

The device of the invention provides the prerequisite for a rapid insertion of the thread take-off and, therefore, for secure joining at high speeds. It is particularly advantageous if a method is carried out for this purpose in accordance with the invention such that the thread is drawn off for the purposes of joining from the spool to such an extent that the thread reaches the side of the spool which faces away from the front of the pressure roller provided with recesses, and that the thread is inserted into the spinning chamber and joined and in addition is conveyed past the front of the pressure roller using the thread tension and is introduced into the clamping line of the pair of draw-off rollers and is immediately subjected at this point to a predetermined take-off.

DESCRIPTION OF A PREFERRED EMBODIMENT

Figure 1:
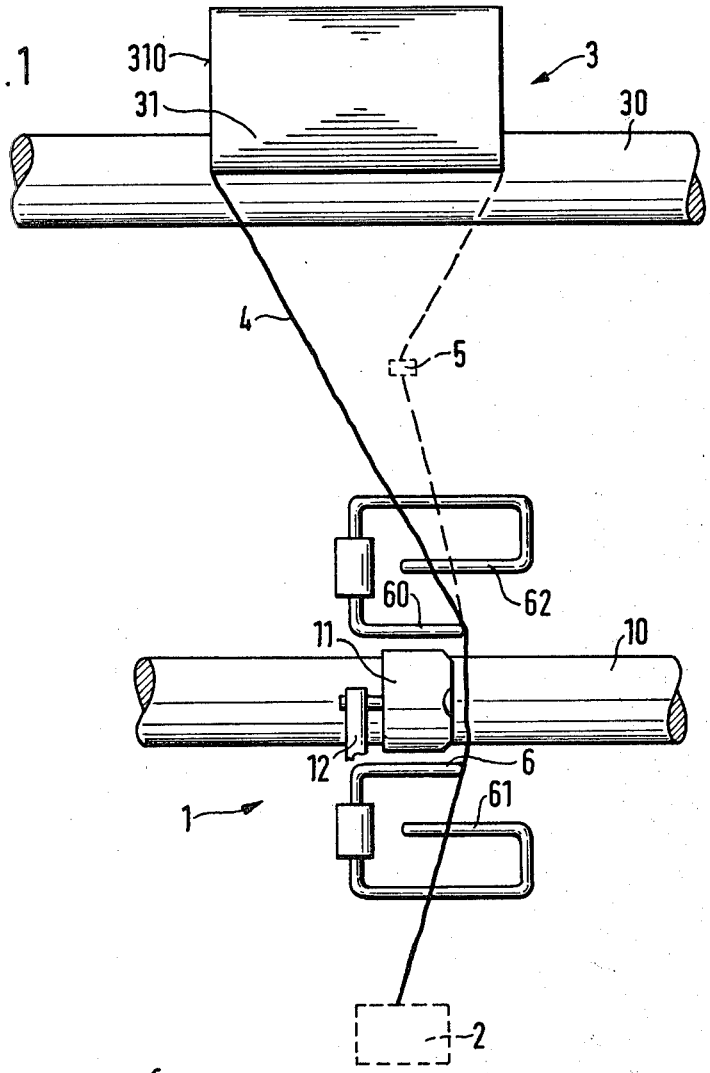
FIG. 1 is a front elevational view of an open-end spinning machine having a thread draw-off device constructed in accordance with the invention.

A thread draw-off device 1 of an open-end spinning machine comprises in a known manner a driven roller 10 and a pressure roller 11 cooperating with the latter, the roller 11 being over-mounted on a lever 12 and being maintained in resilient contact with the roller 10 by means which are not shown (FIG. 1). The thread draw-off device 1 draws the thread 4 from a (diagrammatically illustrated) spinning chamber 2 and conveys it to a winding-on device 3 which comprises a drive roller 30 and a spool 31 which is supported on the latter. The thread is fed during winding-on in a known manner which is, therefore, not illustrated.

Figure 2:
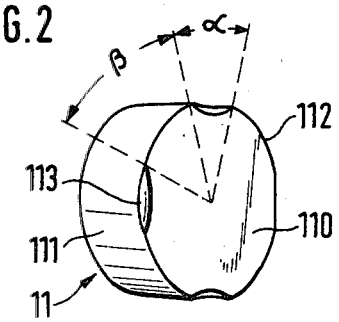
FIGS. 2 and 3 are perspective views of two different embodiments of the invention of the pressure roller.

The lateral edge 112 of the pressure roller 11 separating the front 110 from the peripheral surface 111 has at least one recess 113 (FIG. 2).

This recess 113 is dimensioned in such a way that the thread 4, when it moves along the surface of the driven roller 10 in the direction of the pressure roller 11 and reaches the area of the front 110 is temporarily completely released by the recess 113 so that the thread 4 is caused to move into the area of the clamping line of the thread draw-off device 1 as a result of a traction being exerted on it. As a function of the diameter of the pressure roller, an angle $\alpha$ of at least 20° of the periphery of the pressure roller 11, over which the recess 113 extends, has proved sufficient.

Figure 3:
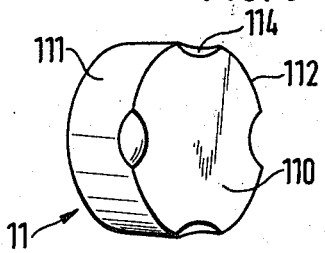
Figure 4:
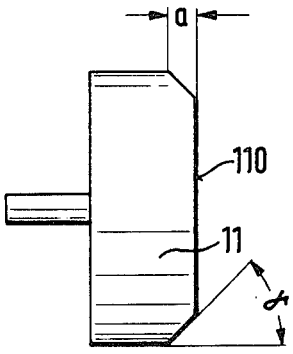
FIG. 4 shows a side view of the pressure roller constructed in accordance with the invention.

During joining, the thread or yarn 4 is drawn off from the spool 31 until the thread 4 reaches the side 31 of the spool which faces away from the front 110 of the pressure roller provided with recesses. After the thread has been brought in the known manner to the correct joining length and introduced into the spinning chamber 2, the thread 4 is brought to a position such that on release it reaches the clamping line of the pair of draw-off rollers 10, 11 under the effect of the thread tension without coming into contact with the front 110 of the pressure roller 11 before reaching the clamping line. By way of the recess 113 in the lateral edge 112 of the pressure roller 11, which reaches during rotation of the pressure roller 11 the area of the clamping line of the pair of draw-off rollers 10, 11, the thread 4 is released for a period such that it is able to pass into this area between the pressure roller 11 and the roller 10, so that after the recess 113 has passed the clamping line area of the pair of draw-off rollers 10, 11, the thread is located in the clamping line area of the pair of draw-off rollers 10, 11 and is securely gripped and drawn off. The thread 4 is then subjected to a predetermined take-off immediately on reaching the clamping line of the pair of draw-off rollers 10, 11. In order that the thread 4 is released for a sufficient period and may, therefore, move sufficiently far along the clamping line between the pressure roller 11 and the roller 10, it is necessary to make the recesses 113 project to a sufficient extent into the peripheral surface of the pressure roller 11. In this respect, a measurement of 1.5 to 5 mm has proved to be particularly advantageous. It is obvious that the recesses must be sufficiently deep in order to enable the thread 4 to penetrate into the recess 113. This is, as a rule, obtained in that the recesses 113 are formed as chamfers, which extend at an angle $\gamma$ of between 30° and 60° to the tangent lying at the peripheral surface 111 (FIG. 4). The angle $\gamma$ may naturally vary, according to the size of the recesses, particularly if the recesses 114 have a curved development (FIG. 3) or another shape.

In the embodiment shown, the front 110 provided with recesses 113 or 114 faces the side 310 of the spool 31, at which point the thread 4 reaches the spool 31 at the time of joining. The thread 4 is, for example, drawn off from the spool 31 for the purposes of joining to an extent such that it constantly reaches the same side 310 of the spool 31. In the embodiment shown in FIG. 1, this is the left-hand side 310 of the spool 31, looking from the operating side of the machine. The pressure roller 11 is arranged in the course of the thread to be drawn off in such a way that the front 110 provided with recesses 113 or 114 is on the right-hand side. In this way, it is ensured that the thread 4 is drawn, during joining, into the clamping line of the pair of draw-off rollers as a result of increasing joining tension, so that rapid gripping of the thread 4 by the pair of draw-off rollers 10, 11 is ensured.

If it is desired, for example for automatic joining, a thread guide 5 may also be provided in the thread path between the pair of draw-off rollers 10, 11 and the winding-on device 3. The thread guide 5 draws the thread 4 into the clamping line of the pair of draw-off rollers 10, 11 as a result of the increasing thread tension.

In order to obtain a particularly rapid insertion of the thread 4 after it has reached the clamping line of the pair of draw-off rollers 10, 11, more than two recesses 113 or 114 are advantageously provided in the lateral edge 112 of the pressure roller 11. A particularly large number of recesses 113 or 114 may be provided when the lateral edge 112 between two adjacent recesses 113 or 114 is shorter than the recesses themselves. It has been shown that it is sufficient for the remaining lateral edge 112 between two adjacent recesses 113 or 114 to extend over an angle $\beta$ which is smaller than the angle $\alpha$, so that 6 to 8 recesses 113 and 114 are possible.

If the thread 4 is laterally deflected at the moment of release, at a correspondingly acute angle to the roller 10, the thread 4 reaches the roller 10 as a result of the increasing thread tension after taking up contact with the fibers in the spinning chamber 2 without coming into contact with the front 110 of the pressure roller 11, the slides along the roller 10 into the clamping line of the pair of draw-off rollers 10, 11. In order to prevent, if the thread 4 is deflected for the purposes of joining in a more perpendicular manner to the course of the roller 10, that the thread 4 comes into contact with the pressure roller 11 before reaching the clamping line of the pair of draw-off rollers 10, 11, the pressure roller 11 is provided with a thread guide element 6 which conveys the thread 4 past the front 110 of the pressure roller 11 under the effect of the thread tension and releases it in the area of the clamping line of the pair of draw-off rollers 10, 11. As a result of the arrangement of the thread guide 5 or by a corresponding selection of the point at which the thread 4 reaches the spool 31, the thread 4 is drawn into the clamping line of the pair of draw-off rollers 10, 11, where it is immediately gripped by the pressure roller 11 as a result of the construction of the latter in accordance with the invention.

According to FIG. 1, a thread guide element 6 and 60 is arranged both behind and in front of the pair of draw-off rollers 10, 11. In order in this respect to further accelerate the insertion of the thread 4 in the clamping line of the pair of draw-off rollers 10, 11, the pressure roller 11 is advantageously associated with a further thread guide element 61 which is arranged at the front 110 of the pressure roller 11 and, as seen from the direction of travel of the thread, in front of the pair of draw-off rollers 10, 11. This thread guide element 61, which is integrated in accordance with FIG. 1 with the thread guide element 6, inserts the thread 4 axially into the area of the clamping line of the pair of draw-off rollers 10, 11 under the effect of the thread tension. This is carried out in that this thread guide element 61 becomes increasingly closer to the pressure roller 11 from its end facing away from the roller 10 to its end facing towards the roller 10 and extends into the area of the clamping line of the pair of draw-off rollers 10, 11.

It is also possible to arrange a further thread guide element 62 of this type after the pair of draw-off rollers 10, 11.

Figure 5:
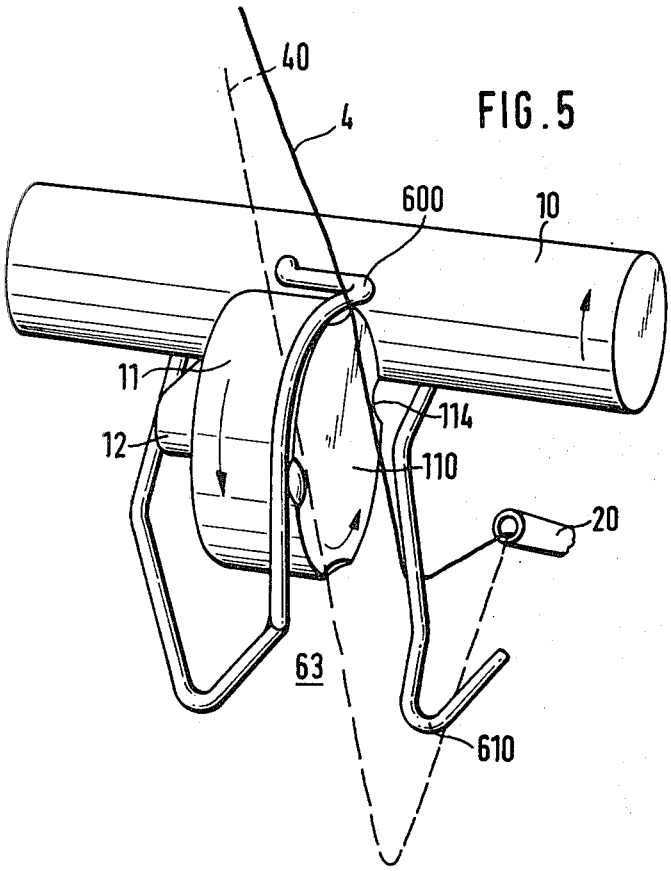
FIG. 5 shows a perspective view of a modified form of the invention.

FIG. 5 shows a preferred embodiment of the draw-off arrangement of the invention. The machine frame (not shown) has secured to it in a suitable manner a hoop forming a thread guide element 600 which extends from below the pair of draw-off rollers 10, 11 (or, in other words, in front of the pair of draw-off rollers 10, 11 in respect of the direction of travel of the thread) to—in respect of the operating side—the front of the pressure roller 11. It then obliquely approaches the underside of the pressure roller 11 (or thread supply side) from this point, then extends approximately perpendicularly upwards (thread delivery side) and surrounds the pressure roller 11 in an arc, as a result of which it projects to a certain extent above the front 110 of the pressure roller 11 and finally extends into the area of the clamping line of the pair of draw-off rollers 11 parallel to this clamping line. A second thread guide element 610 also formed as a hoop is also secured to the machine frame in a suitable manner on the underside of the pressure roller 10, i.e. on its thread supply side. In the area of the common tangent of the roller 10 and the pressure roller 11, this hoop is still located in the area of the clamping line, and then moves away with an increasing spacing from the roller 10 in the direction of the free end of the pressure roller and increasingly further from the front 110 of the pressure roller 11. In this way, the thread guide elements 600 and 610 form together a thread capture zone 63 having a wedge-shaped development.

The thread 4 is drawn off from the spool 31. The thread 4 is then either inserted in the thread guide 5 or drawn off to an extent such that the thread 4 reaches the spool 31 at its side 310 facing away from the front 110 of the pressure roller 11. The free thread end is brought to the correct joining length and inserted into the thread take-off tube 20 of the spinning chamber, and the thread 4 assumes the position 40. The thread 4 is then released and joined in the known way. As a result of the underpressure in the spinning chamber 2, the thread 4 is introduced into the latter and the thread 4 reaches the area of the thread capture zone 63 and is guided by the thread guide elements 600 and 610 into the clamping line of the pair of draw-off rollers 10, 11, where it penetrates into a recess 113 or 114 and is gripped by the pair of draw-off rollers 10, 11 on further rotation of the pressure roller 11 and is immediately subjected to a predetermined take-off.

The thread take-off device of the invention and the method of the invention may be used irrespective of whether the thread 4 to be joined is drawn off from the spool 31 of the machine or from an auxiliary spool on a joining device traveling along the machine. It is, therefore, possible, for example, to control the winding device 3 in dependence on a thread guard (not shown). It is, however, also possible to draw off the thread used for joining from the spool 31 on the machine or from an auxiliary spool on a joining carriage, to join it, to commence the take off, and to deliver the thread pneumatically until the thread is joined to the thread 4 drawn off from the spool 31 of the machine by means of a thread joining device; for example, a knotter.

Substitution of features by equivalent means also lies within the scope of the invention. Equivalent means also include, in this respect, a formation of the pressure roller in which the front 110 of the pressure roller 11 has projecting past it projections which form the axial extension of the peripheral surface of the pressure roller 11 and which have between each other a spacing in the peripheral direction of the pressure roller 11 such that they release the thread which has reached the area of the pressure roller 11 for a period such that it is able to pass into the clamping line of the thread take-off device 1. In this respect, the front of the projections correspond to the front 110 of the pressure roller 11 within the context of the invention.

While a preferred embodiment of the invention has been described using specific terms, such description is for illustrative purposes only, and it is to be understood that changes and variations may be made without departing from the spirit or scope of the following claims.

What is claimed is:

1. A thread drawing-off device for an open-end spinning device having a pair of draw-off rollers comprising an over-mounted pressure roller which cooperates resiliently with a driven roller projecting across the front of the pressure roller comprising:

said thread drawing-off device (3) being positioned between said spinning chamber (2) and a wind-on device;

means for mounting said driven roller (10) between said spinning chamber (2) and said wind-on device (3) so that the thread path extending between said wind-on device (3) and said spinning chamber (2) presses against said driven roller (10);

at least one recess (113, 114) provided on the circumference of one front (110) of said pressure roller (11), said recess being of sufficient size to temporarily completely release a thread (4) sliding along the surface of said driven roller (10) and lying adjacent to the front (110) of the pressure roller (11) so that said thread can be inserted between said driven roller and said pressure roller.

2. A device as claimed in claim 1, characterized in that the recess (113, 114) projects from 1.5 to 5 mm into the peripheral surface (111) of the pressure roller (11).

3. A device as claimed in claim 1 or 2, characterized in that the recess (113, 114) is formed as a chamfer.

4. A device as claimed in claim 3, characterized in that the chamfer (114) is arcuate.

5. A device as set forth in claim 1 further comprising:

at least two recesses (113, 114) provided in the front of said pressure roller (11).

a lateral edge (112) between said two recesses being shorter than said recesses (113, 114).

6. A device as set forth in claim 1 further comprising:

a take-up device including a spool, thread extending from one side of said spool at the moment when said thread is being joined on said open-end device, and said front (110) of said pressure roller (11) facing said one side (310) of said spool.

7. The device as set forth in claim 1 further comprising:

a thread guide means (6–60, 600) for conveying said thread (4) without touching the front (110) of said pressure roller (11) past said front (110) of the same.

8. The device as set forth in claim 7 further comprising:

a further thread guide means (61–62, 610) disposed in front of said pressure roller (11) and, seen from the direction of flow of said thread, in front of said pair of draw-off rollers (10, 11), and which guides said thread (4) axially into said clamping line provided between said pair of draw-off rollers (10, 11) under the influence of said thread tension.

9. The device as set forth in claim 7 further comprising:

said thread guide means forming a thread capture zone (63) having a wedge shape.

10. A method of inserting a thread being wound on a spool of a take-off device in the clamping line between a pair of draw-off rollers including a pressure roller and driven roller after said thread has been joined to thread being produced in a rotor of an open-end spinning device, said method comprising the following steps:

providing recesses on one side of said pressure roller, drawing said thread off of said spool to such an extent that said thread reaches a side of said spool which faces away from a front of said pressure roller provided with recesses;

inserting said thread into said spinning chamber for being joined with fibers being collected therein, conveying said joining thread past said front of said pressure roller provided with recesses, and allowing the thread tension to introduce said thread into the clamping line of said pair of draw-off rollers as said thread passes between said recess of said pressure roller and said driven roller.

* * * * *